US005429357A

United States Patent [19]

Kobayashi

[11] Patent Number: 5,429,357

[45] Date of Patent: Jul. 4, 1995

[54] GOLF CLUBHEAD AND ITS METHOD OF MANUFACTURING

[75] Inventor: Kenji Kobayashi, Tsubame, Japan

[73] Assignee: Kabushiki Kaisha Endo Seisakusho, Japan

[21] Appl. No.: 43,165

[22] Filed: Apr. 5, 1993

[30] Foreign Application Priority Data

| | | | |
|---|---|---|---|
| May 1, 1992 | [JP] | Japan | 4-112873 |
| May 1, 1992 | [JP] | Japan | 4-112874 |
| May 1, 1992 | [JP] | Japan | 4-112875 |
| May 29, 1992 | [JP] | Japan | 4-139134 |
| Oct. 7, 1992 | [JP] | Japan | 4-268742 |
| Oct. 8, 1992 | [JP] | Japan | 4-270435 |
| Nov. 12, 1992 | [JP] | Japan | 4-302585 |
| Nov. 13, 1992 | [JP] | Japan | 4-303954 |

[51] Int. Cl.[6] ..... A63B 53/02; A63B 53/04

[52] U.S. Cl. ..... 273/80.2; 273/167 H; 273/172

[58] Field of Search ..... 273/167 R, 167 A, 167 H, 273/167 F, 169, 77 R, 173, 175, 167 G, 80.1, 80.2, 80.3, 80.4, 80 C, 167 J, 193 R, 194 R, 172

[56] References Cited

U.S. PATENT DOCUMENTS

| | | | |
|---|---|---|---|
| 1,582,836 | 4/1926 | Link | 273/167 H |
| 4,214,754 | 7/1980 | Zebelean | 273/167 H |
| 4,429,879 | 2/1984 | Schmidt | 273/173 |
| 4,438,931 | 3/1984 | Motomiya | 273/167 H |
| 4,444,392 | 4/1984 | Duclos | 273/167 H |
| 4,516,778 | 5/1985 | Cleveland | 273/167 H X |
| 4,602,787 | 7/1986 | Sugioka | 273/167 H X |
| 4,681,321 | 7/1987 | Chen | 273/167 H |
| 5,094,383 | 3/1992 | Anderson | 273/167 H X |
| 5,232,224 | 8/1993 | Zeider | 273/167 H |
| 5,244,211 | 9/1993 | Lukasiewicz | 273/167 H X |

FOREIGN PATENT DOCUMENTS

| | | | |
|---|---|---|---|
| 2225725 | 6/1990 | United Kingdom | 273/167 H |
| 2230459 | 10/1990 | United Kingdom | 273/167 H |

*Primary Examiner*—Sebastiano Passaniti
*Attorney, Agent, or Firm*—Quarles & Brady

[57] ABSTRACT

There are described a plurality of composite structures of a golf clubhead of a so-called "metal wood" in order to enlarge the sweet area on a ball hitting surface thereof. A method of manufacturing such golf clubheads is also described. A golf clubhead is described having an enlarged hollow portion therein by combining a plurality of crusts formed by press working of metal plates such as titanium, titanium alloy or the like. The thickness of each crusts is capable of being easily adjusted, so that the center of gravity of the golf clubhead can be positioned toward the back, which allows the sweet area to be enlarged.

6 Claims, 27 Drawing Sheets

FIG. 17A
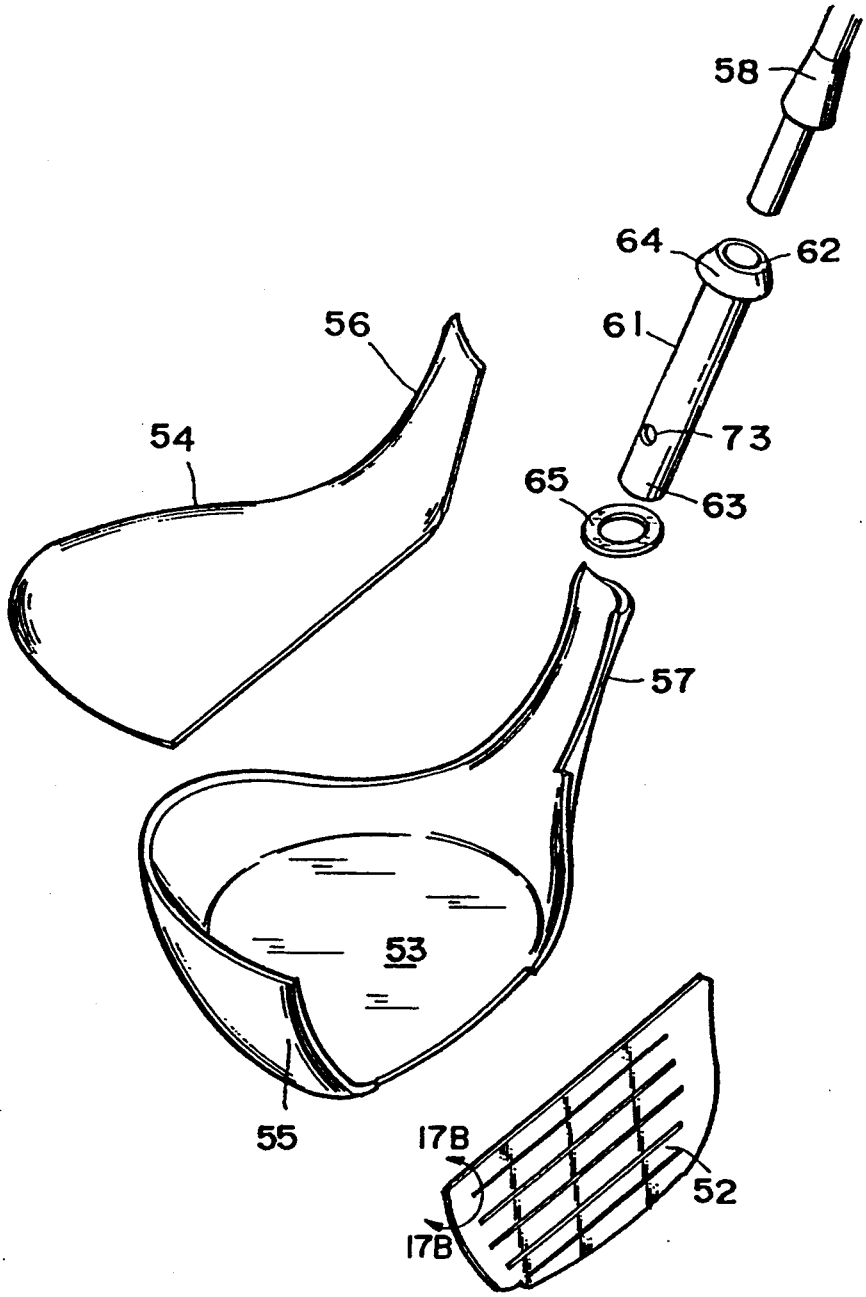
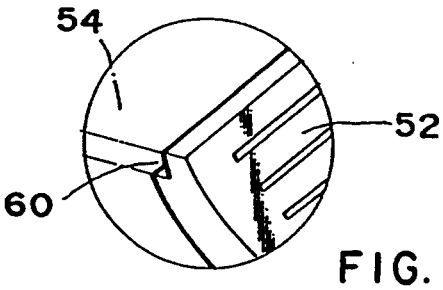
FIG. 17B

FIG. 19A
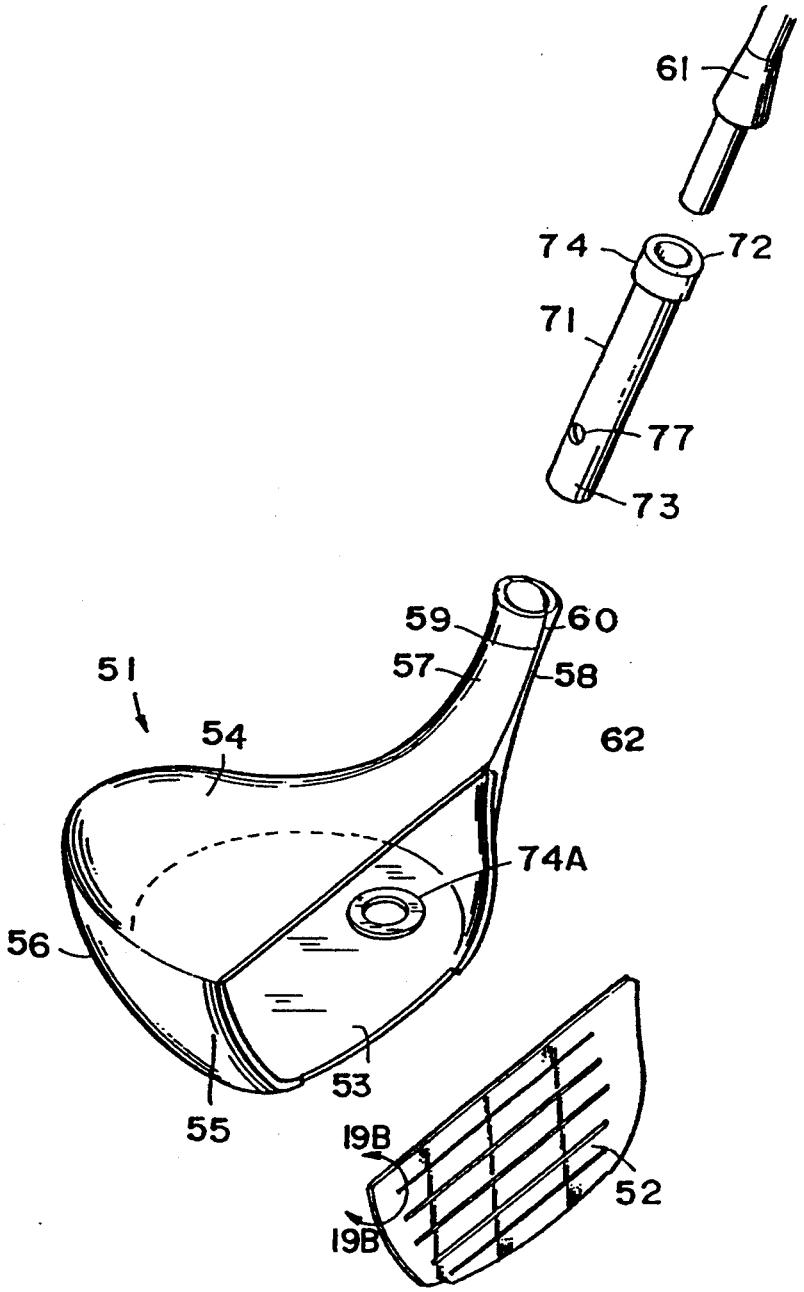
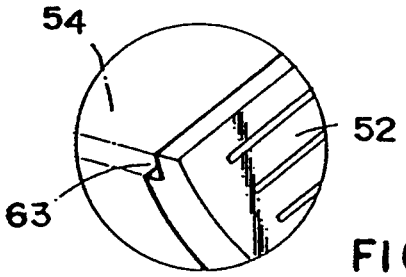
FIG. 19B

GOLF CLUBHEAD AND ITS METHOD OF MANUFACTURING

BACKGROUND OF THE INVENTION (a) Field of the Invention

The present invention relates to a golf clubhead of so-called "metal wood golf club head," from No. 1 to No. 3, etc., and its manufacturing method.

(b) Description of Prior Art

Golf clubheads called "metal wood golf club heads" have heretofore been manufactured by a lost wax process, i.e., a process of pouring melted metal into a casting mould obtained by removing an original wax die attached thereto. Conventional lost wax process admittedly made make it possible to precisely mould each surface of a golf clubhead, but it still does not permit varying each thickness of each surface thereof to a great degree.

It is well known that lowering the center of gravity of a golf clubhead allows balls to be hit farther. In accordance with conventional lost wax process, however, it is impossible to lower the center of gravity to a large degree or by a great amount, because it does not permit varying each thickness of each surface of a golf clubhead in a large measure as described above. Consequently, the distance between a face inclined at a predetermined loft angle and the center of gravity of a golf clubhead can not be sufficiently elongated, so that what is called "sweet area" or "sweet spot" on the face cannot be enlarged further.

SUMMARY OF THE INVENTION

It is, therefore, an object of the present invention to provide a golf clubhead having a wide sweet area so that hitting mistakes may be further decreased.

It is another object of the present invention to provide a method of manufacturing such clubheads which have the above-described wide sweet area.

According to a major feature of the present invention, there is provided a head body of a composite structure formed by combining a plurality of shell members, each of a thickness which is easy to adust so that a hollow portion therein may be enlarged and the center of gravity may be transferred toward the back of the head body.

BRIEF DESCRIPTION OF THE DRAWINGS

Other objects, features and advantages of the invention will be apparent to those skilled in the art from the following description of the preferred embodiment of the invention, wherein reference is made to the accopmpanying drawings, of which:

FIGS. 17 to 18 illustrate a clubhead structure of the seventh embodiment of the present invention.

FIGS. 19 to 20 illustrate a clubhead structure of the eighth embodiment of the present invention.

DETAILED DESCRIPTION OF THE PREFERRED EMBODIMENTS

Figure 1:
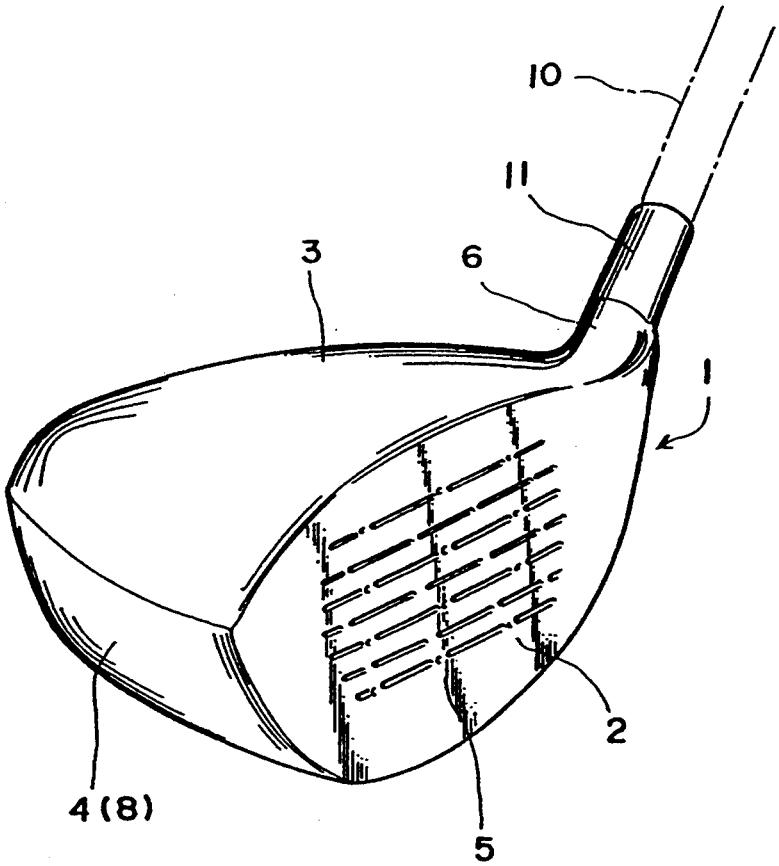
FIG. 1 is a perspective view showing a golf clubhead of the first embodiment of the present invention.
Figure 2:
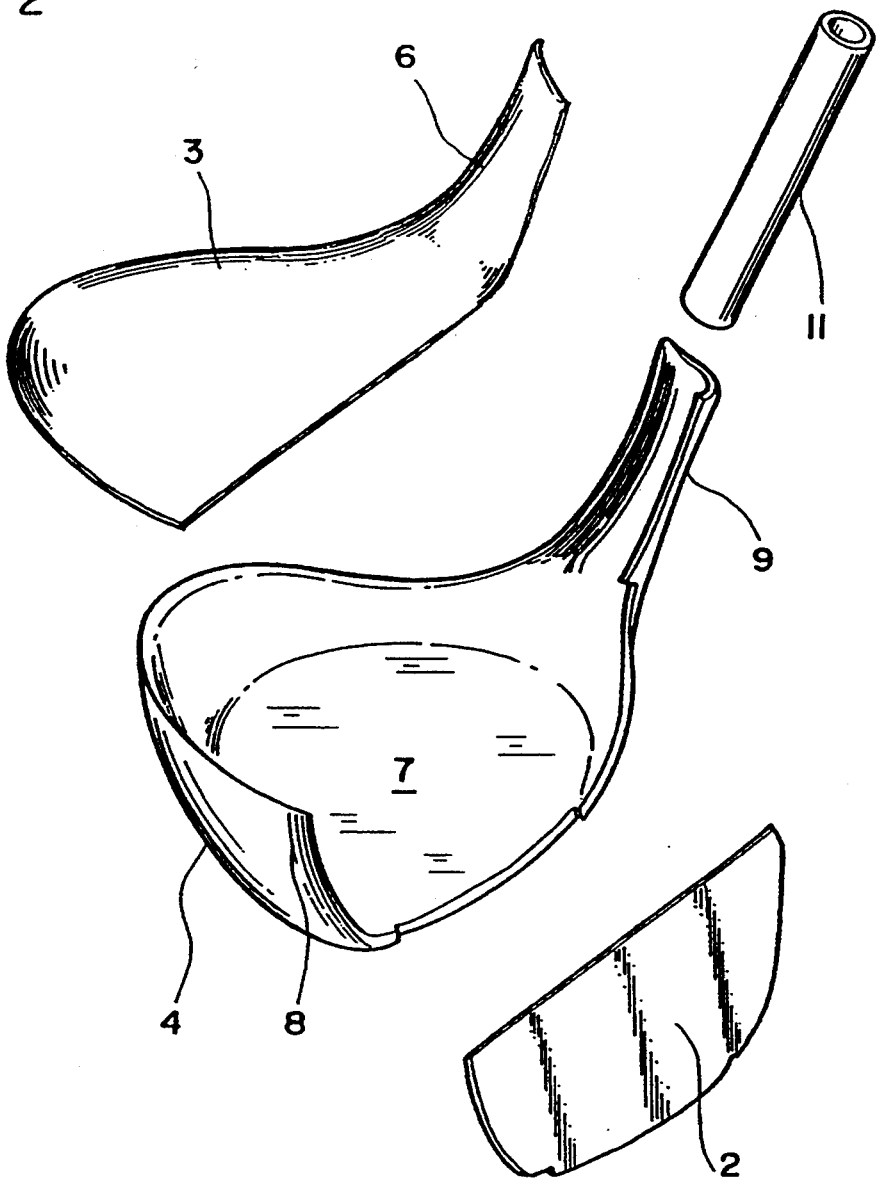
FIG. 2 is an exploded perspective view showing a golf clubhead structure of the first embodiment of the present invention.
Figure 3:
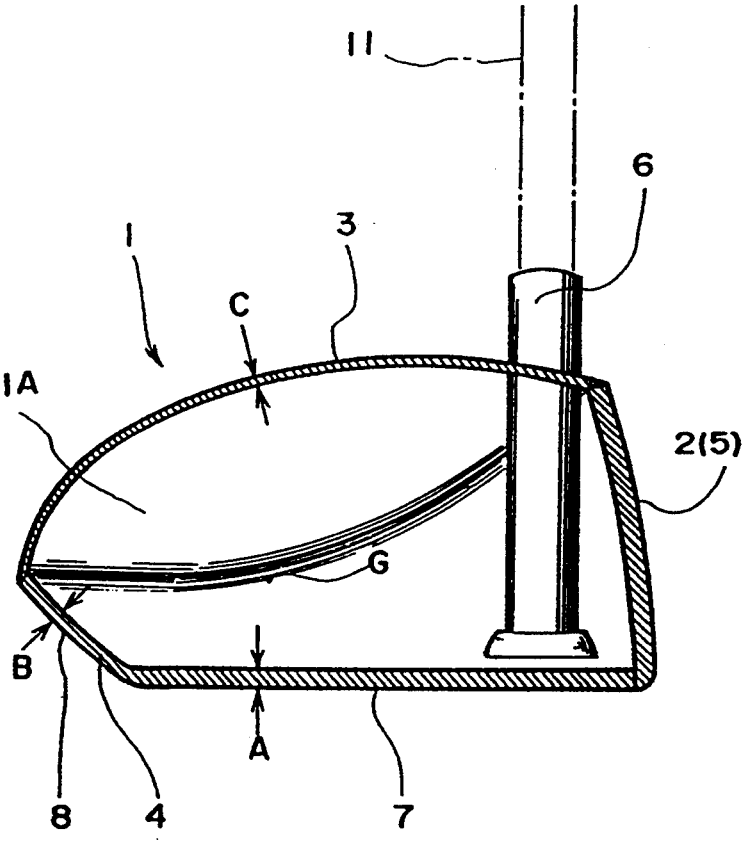
FIG. 3 is a sectional view showing a golf clubhead structure of the first embodiment of the present invention.

In FIGS. 1 to 3 showing the first embodiment of the present invention, there is provided head body 1, which is integrally formed by welding and combining the edges of face shell 2, upper shell 3, side and sole shell 4 so as to form hollow portion 1A. Said shells are formed by press working of metal plates of titanium (with a specific gravity of approximately 4.5), titanium alloy, and aluminium alloy (with a specific gravity of approximately 2.7). The front surface of said face shell 2 is formed with a face 5, while one side of said upper shell 3 is provided with semicylindrical member 6 extending obliquely upward. Said side and sole surface 4, having a sole 7 in the lower part thereof, is formed with side surface 8 so that it may cover the both sides and the back of said shell 4. As shown in FIG. 2, from one side of said side surface 8, there extends obliquely upwards semicylindrical member 9. Sandwiched by said semicylindrical members 69 is shaft mounting pipe 11, of which the upper end is secured to said semicylindrical members 69, while the lower end thereof is secured to sole 7. To thus formed pipe 11 is fixed the lower end of a shaft 10. In pressing said plates, as shown in FIG. 3, the thickness A of sole 7 is formed larger than the thickness B of said side surface 8, which is formed larger than the thickness C of upper surface shell 3.

With the structure thus made, metal plates of titanium, titanium alloy, or aluminium alloy with comparatively small specific gravities are integrally formed into said shells by press working so that each thickness of said shells A,B and C can be optionally provided or selected, whereby the head body 1 can be of the larger size with said hollow portion 1A enlarged, in spite of the same weight of said head body 1 of comparably smaller size. Accordingly, the center of gravity G is displaced to the back to elongate the distance between said face 2 and said center of gravity, so that sweet area on said face 2 can be enlarged. Further, as each shell of head body 1 is formed by press working, an optional part thereof can be formed thicker, while another part thereof can be thinner to adjust the thicknesses of said shells, whereby the weight distribution of the head body 1 can be easily controlled. Furthermore, this easy controlling of the thickness of each of the shells allows the head body to be provided without any reinforcing ribs in said hollow portion 1A thereof. Still furthermore, since the thickness A of sole 7 is formed larger than the thickness B of said side surface 8, which is formed larger than the thickness C of upper surface shell 3, the center of gravity of head body 1 can be lowered still downward to elongate the distance between face shell 2 and said center of gravity G so that face shell 2 can be provided with ultra wide sweet area.

Figure 4:
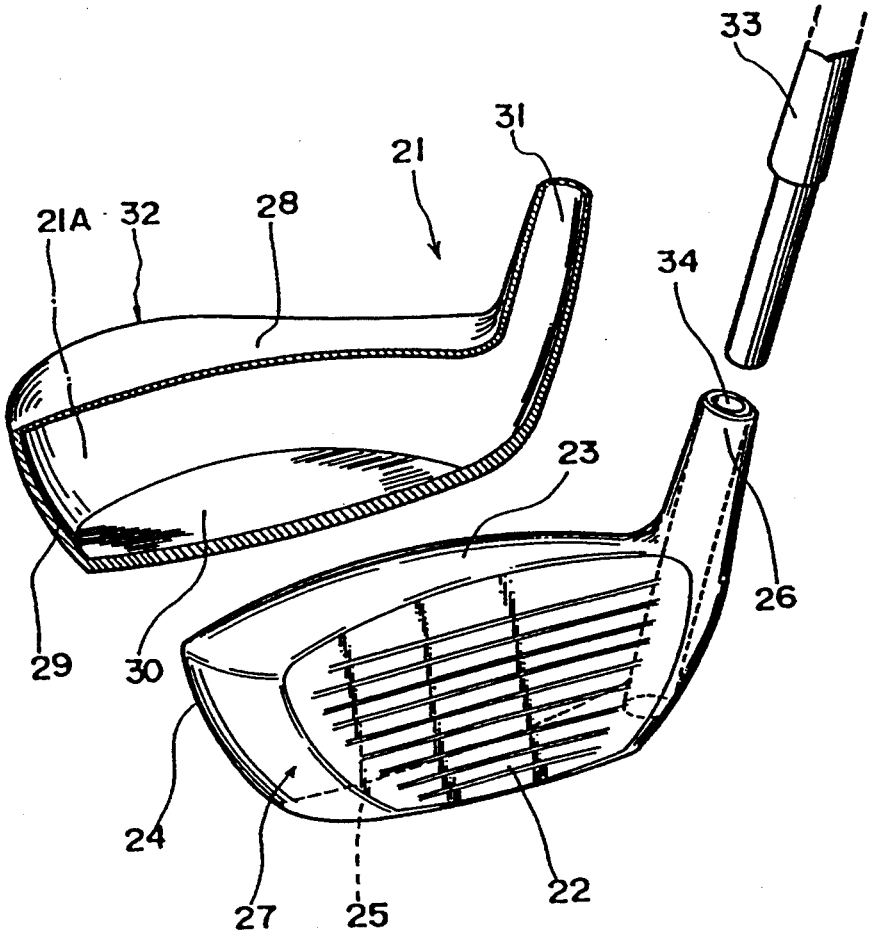
FIG. 4 is an exploded perspective view showing a clubhead structure of the second embodiment of the present invention.
Figure 5:
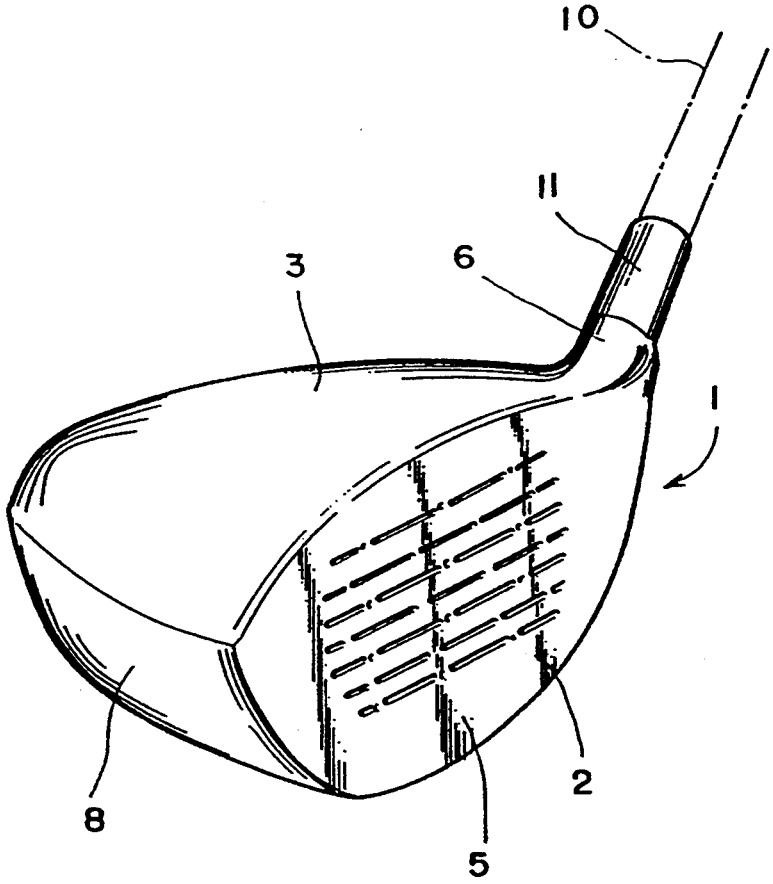
FIGS. 5 to 8 also illustrate a clubhead structure of the third embodiment of the present invention.

In FIG. 4 showing the second embodiment of the invention, there is provided head body 21 comprising: face 22; front shell 27 composed of front upper surface 23, front side peripheral surface 24, front sole 25 and semicylindrical portion 26; backshell 32 composed of back upper surface 28, back side peripheral surface 29, back sole 30 and semicylindrical member 31, which are formed by press working respectively. Sandwiched by said semicylindrical members 31 and 26 and incorporated therein is shaft mounting pipe 34 for mounting shaft 33 thereto. After that, edges of said front shell 27 and back shell 32 are integrally combined by welding them.

In pressing said front shell, front sole 25 is to be formed thicker than said front side peripheral surface 24, which is to be formed thicker than said front upper surface 23. Likewise, back sole 30 is to be formed thicker than said back side peripheral surface 29, which is to be formed thicker than said back upper surface 28.

With the structure thus made, the second embodiment of the invention can also enlarge hollow portion 21 A without adding to the weight of head body 21, and easy controlling of the thicknesses of said shells makes it possible to position the center of gravity of head body 21 still backward, so that the distance between face 22 and the center of gravity can be elongated to further enlarge the "sweet area". Moreover, since front and back soles 25 and 30 are formed thicker than said front and back side peripheral surfaces 24 and 29 which are formed thicker than said front and back upper surfaces 23 and 28, the center of gravity of the head body 21 can be lowered still downward to provide a golf clubhead with ultra wide sweet area.

In FIGS. 5 to 8 showing the third embodiment of the invention, the same portions as those of the foregoing first embodiment are designated with the same reference numerals, and their repeated detail description will be omitted. Drawings unrelated to the invention such as score lines on a face will be sometimes omitted too.

Figure 6:
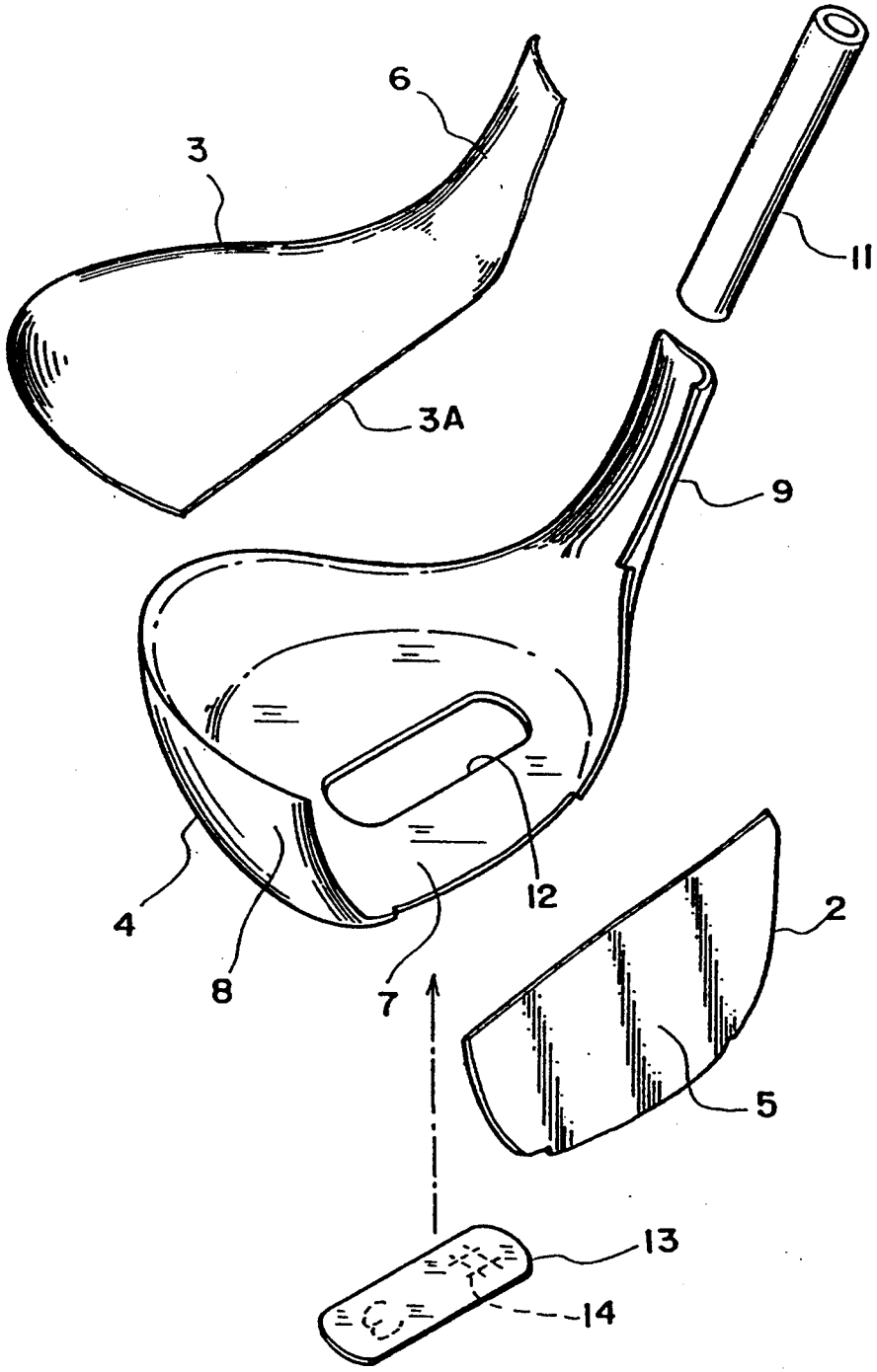
Figure 7:
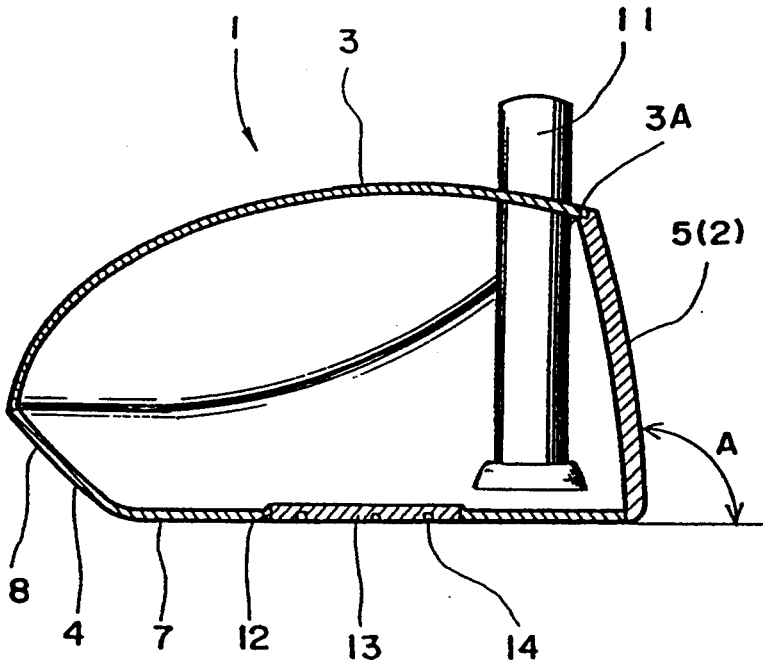
Figure 8:
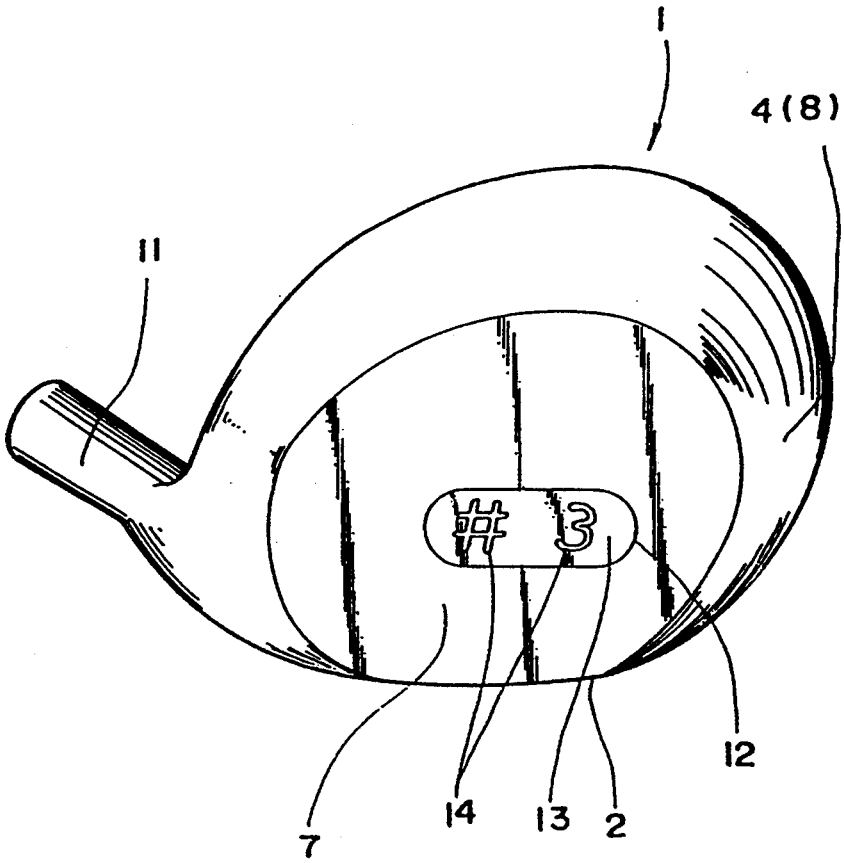

As shown in FIG. 6, said sole 7 is formed with window-like hole 12, to which is to be welded display plate 13 formed of stainless steel (with a specific gravity of approximately 7.9), iron, or beryllium cupper alloy (with a specific gravity of approximately 8.2). The lower surface of said display plate 13 is provided with display portion 14 marked with the number 3 or the like by means of press or shotblast method or the like.

Said face shell 2, upper shell 3, side and sole shell 4 are pressed by means of dies respectively, and display plate 13 with display portion 14 marked in advance by pressing or the like is welded into window-like hole 12 of said sole 7. First, pipe 11 is welded to side and sole shell 4, secondly, upper shell 3 is welded to said side and sole shell 4, while semicylindrical member 6 is welded to pipe 11. After thus forming the fundamental structure of head body 1, face 5 is integrally welded to head body 1 at a predetermined loft angle, which is deburred and polished into a final product.

Since display plate 13 with display portion 14 made of metallic material other than that of head body 1 is provided in window-like hole 12 of sole 7, said display portion 14 is able to be easily provided, It is because display plate 13 can be formed of stainless steel, iron, or beryllium cupper alloy or the like having such comparatively low intensities that they are easy to work, even if side and sole shell 4 is formed of titanium or the like having comparatively high intensities and small specific gravities. Further, as said display plate 13 is formed of a metallic material having a comparatively large specific gravity, the center of gravity of head body 1 can be lowered so that golf balls may be driven more easily.

Figure 9:
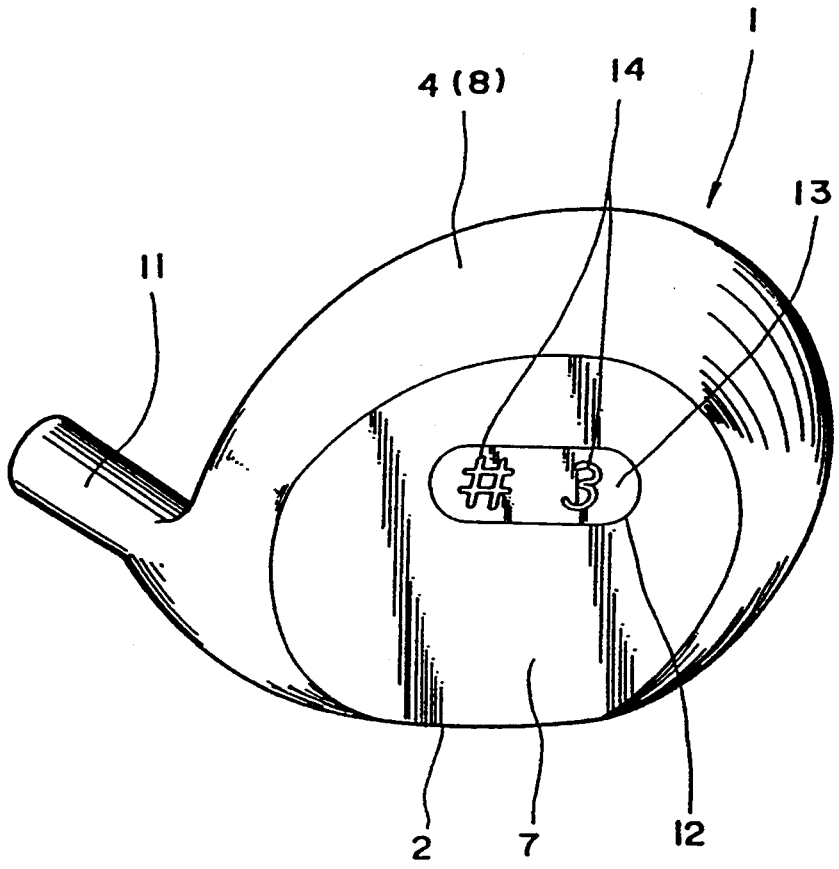
FIG. 9 is a bottom plan view showing a clubhead structure of the fourth embodiment of the present invention.
Figure 10:
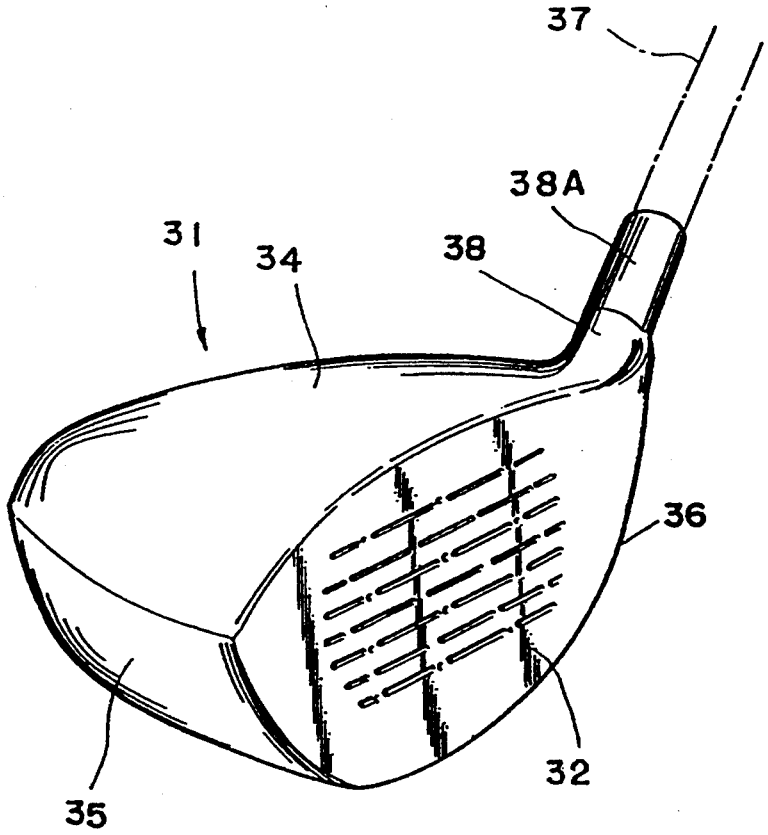
FIGS. 10 to 13 illustrate a clubhead structure of the fifth embodiment of the present invention.
Figure 11:
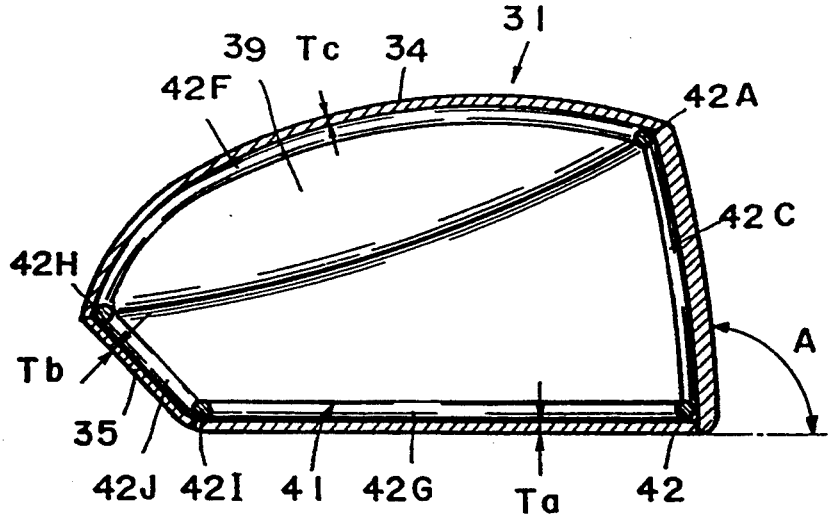
Figure 12:
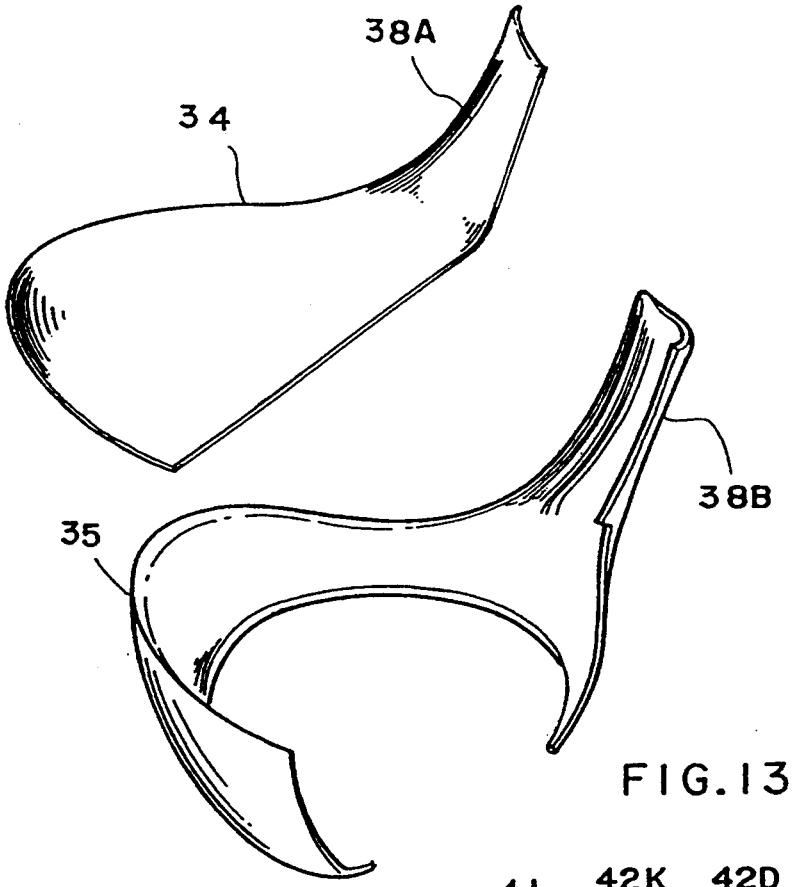
Figure 13:
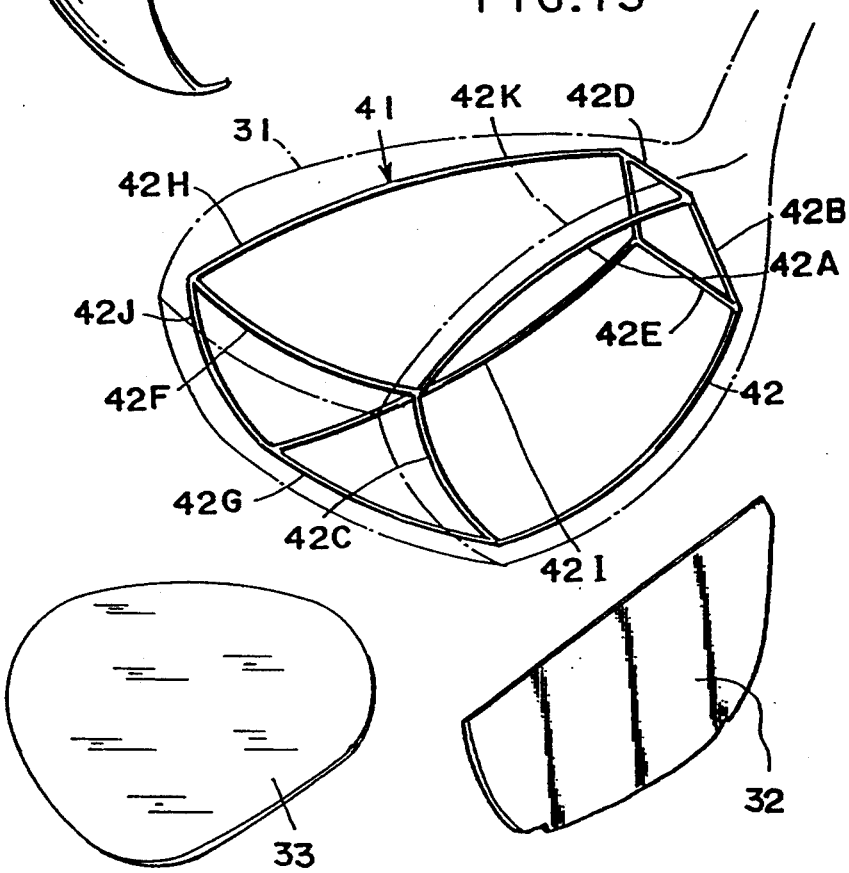

In FIG. 9 showing the fourth embodiment of the invention, the back of sole 7 is formed with window-like hole 12, into which is welded display plate 13 with display portion 14 formed therein, Therefore, the structure of the fourth embodiment has the same advantage as the third embodiment, and is uniquely advantageous because the sweet area of face 2 is enlarged because of the center of gravity being transferred backward.

In FIGS. 10 to 13 showing the fifth embodiment of the invention, there is provided head body 31 made of aluminium alloy, stainless steel, iron or the like comprising: face shell 32 provided in the front of said head body 31 at a predetermined loft angle; sole shell 33 provided in the lower surface; upper shell 34; side and back shell 35 provided laterally and in the back of said head body 31. From the heel 36 side of head body 31, there extends obliquely upward cylindrical mounting portion or neck 38 for mounting shaft 37 thereto. These shells are manufactured by forging metal plates, and the thicknesses thereof diminish in the following sequence, the thickness "Ta" of sole shell 33, the thickness "Tb" of side and back shell, 35, the thickness "Tc" of upper shell 34. (i.e., $Ta > Tb > Tc$).

One side of said upper shell 34 is integrated with semicylindrical member 38A, while the same side of said side and back shell 35 is integrated with semicylindrical member 8B respectively.

Hollow portion 39 in head body 31 is provided with frame 41, which is formed by linking a dozen linear members 42, 42A, 42B . . . 42K made of, for example, stainless steel so that they are disposed in the inner edge lines of an approximately cubic portion corresponding to said hollow portion 39.

In the case of manufacturing head body 31, face shell 32 manufactured in advance is to be welded to the front of said frame 41 integrally formed by linking said linear members 42, . . . 42K, sole shell 33 is welded to the lower part thereof, upper shell 34 is welded to the upper part thereof, side and back shell 35 is welded to the lateral and back part thereof respectively. After each shells 32,33,34,35 is integrated with one another to form head body 31 by means of said frame 41, said head body 31 is polished as surface-treatment. Thereafter, shaft 37 is inserted into and connected with mounting portion 38 of said head body 31.

Since the structure of the fifth embodiment of the invention is thus made, the impact pressure developed in face shell 2 by hitting balls can be resisted by sole shell 33, upper shell 34, side and back shell 35 due to said frame 31, so that a head body 31 having excellent intensity can be provided.

Further, the excellent intensity of said head body 31 due to frame 41 allows the thicknesses of each shells 32,33,34 and 35 to be lessened so that head body 31 can be provided with its hollow portion enlarged therein too. Furthermore, as frame 31 disposed in hollow portion 39 is manufactured in advance, a loft angle A can be determined in advance too, whereby the process of manufacturing a golf clubhead can be simplified.

Figure 14:
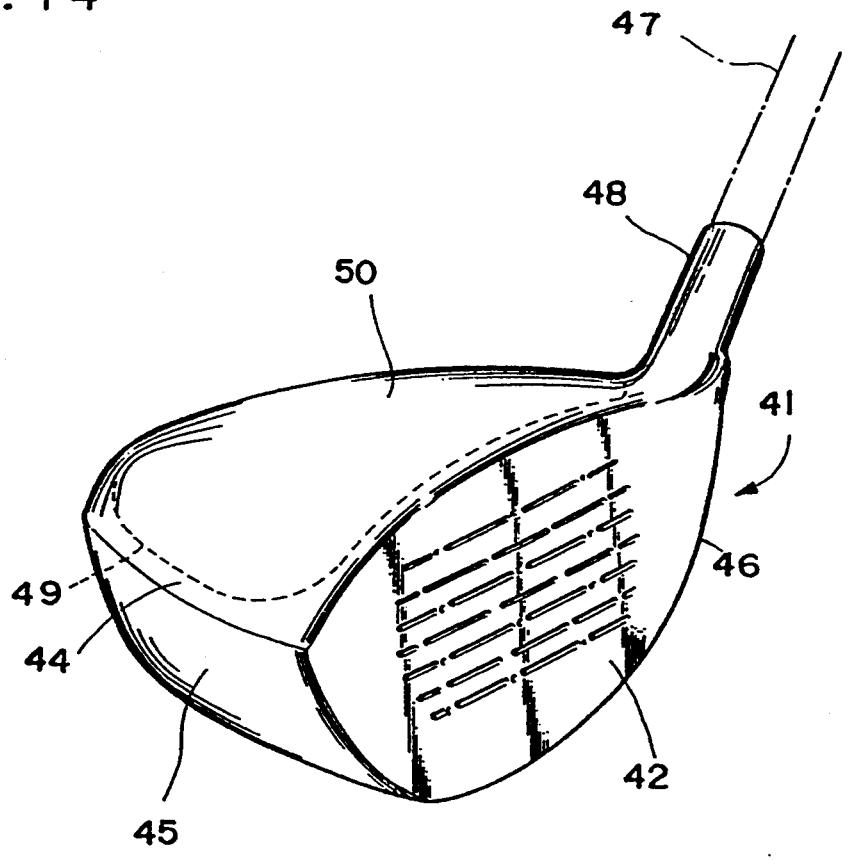
FIGS. 14 to 16 illustrate a clubhead structure of the sixth embodiment of the present invention.
Figure 15A:
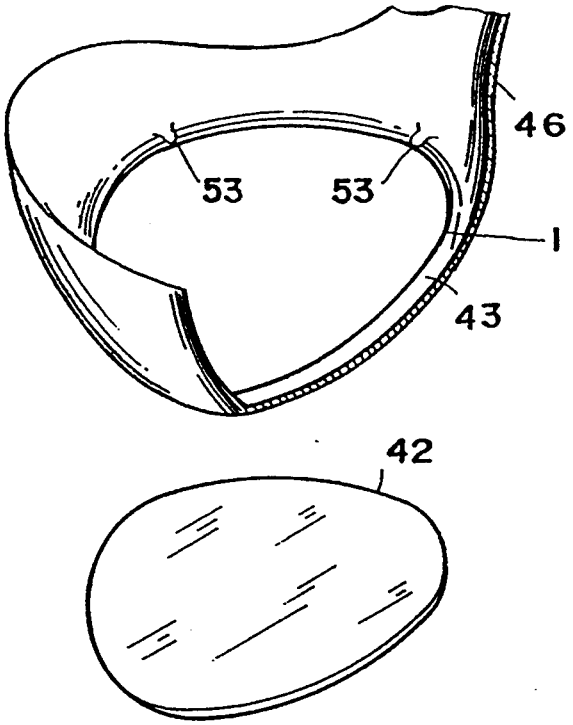
Figure 15B:
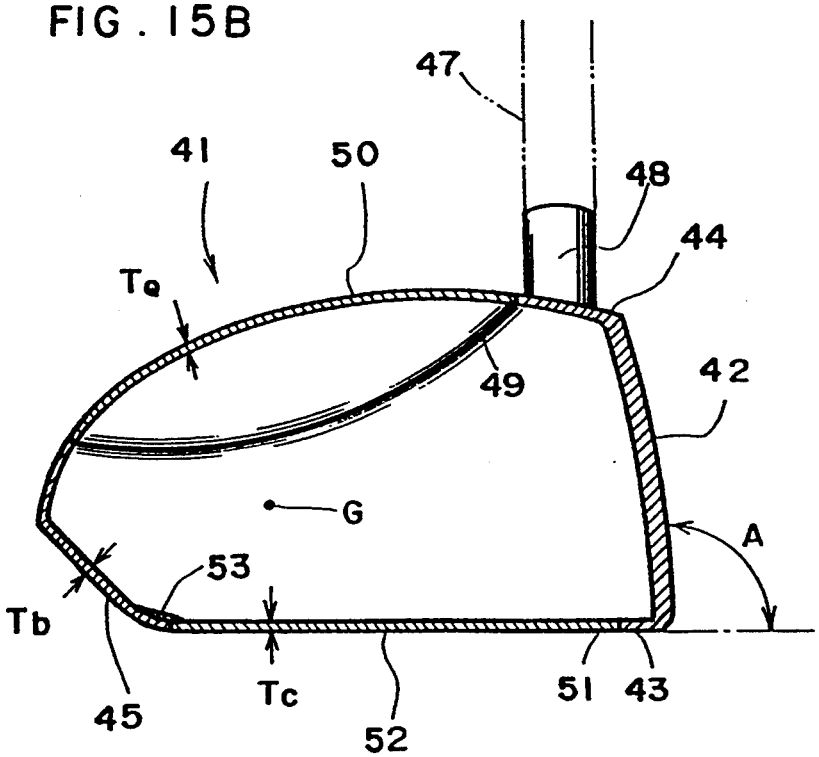
Figure 16:
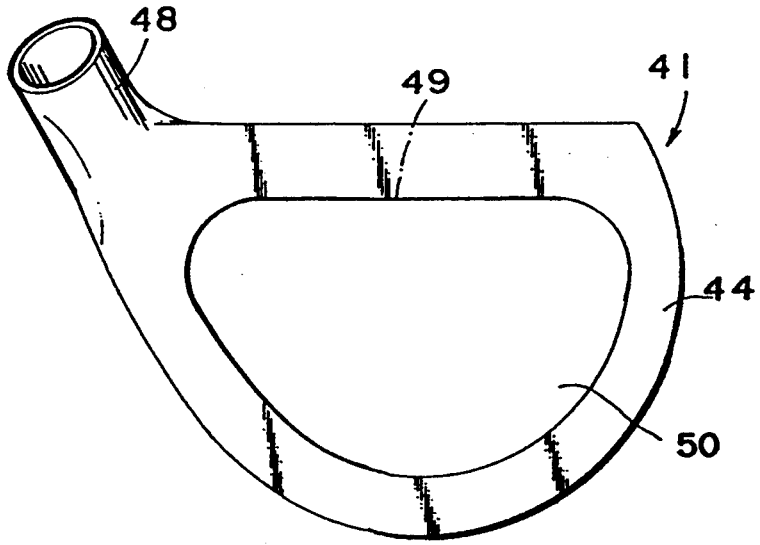

In FIGS. 14 to 16 showing the sixth embodiment of the present invention, there is provided head body 41 integrally formed by metallic plate which is made of aluminium alloy or stainless steel, iron or the like, wherein said head body 41 may be manufactured by above-mentioned lost wax process.

Said head body 41 comprises: face shell 42 provided at the front of said head body 41, inclining at a predetermined loft angle; sole shell 43 provided at the lower surface thereof; upper shell 44 provided at the upper surface thereof; peripheral shell 45 provided laterally and at the back thereof. From the heel 46 side of head body 41, there extends obliquely upward shaft mounting portion or neck 48 for mounting shaft 47 thereto. The substantially full face of said upper shell 44 is formed with upper window-like hole 49, into which is fitted upper shell member 50 so as to be welded or bonded thereto. As shown in FIG. 15(A), the substantially full face of said sole shell 43 is formed with sole window-like hole 51, into which is fitted sole member 52 so as to be welded or bonded thereto. Inside head body 41 and a little upward relative to said sole window-like hole 51 is provided three stopper-protrusions 53 to anchor said sole member 52.

In the case that the materials of said upper shell member 50 and sole shell member 52 are the same as that of head body 41, the thickness "Ta" of said upper shell member 50 is smaller than the thickness "Tb" of head body 41 except face shell 42, while the thickness "Tc" of said sole member 52 is larger than the thickness "Tb" of head body 41. (i.e., $Ta<Tb<Tc$). After upper shell member 50 and sole shell member 52 are integrated with head body 41, shaft 47 is to be connected with shaft mounting portion 48.

Since upper shell member 50 is formed thinner while sole shell member 52 is formed thicker, the center of gravity of head body 41 is biased toward sole shell member 52, so that the distance between the surface of face shell 42 and the center of gravity G can be elongated. Consequently, a sweet area in hitting balls is able to be enlarged.

Figure 18:
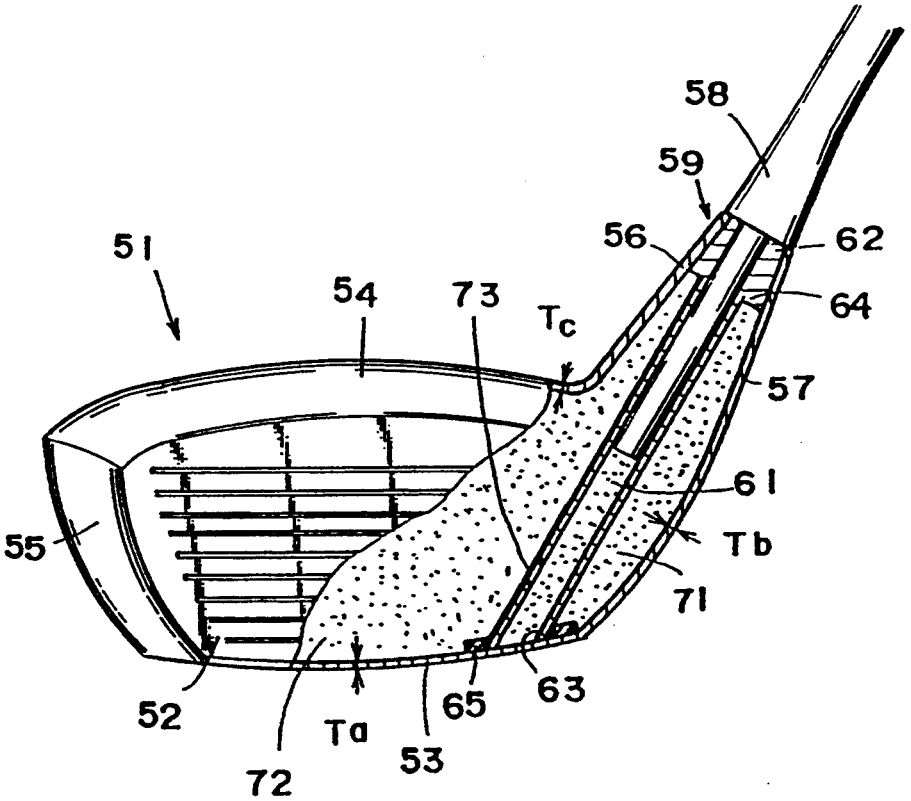

In FIGS. 17 to 18 showing the seventh embodiment of the present invention, there is provided head body 51 which is made of aluminium alloy or stainless steel, iron or the like which comprises: face shell 52 provided at the front of said head body 51, inclining at a predetermined loft angle; sole shell 53 provided at the lower surface thereof; upper shell 54 provided at the upper surface thereof; lateral side and back shell 55 provided laterally and at the back thereof. Said sole shell 53 and said lateral side and back shell 55 are integrally provided.

From one side of head body 51, there extends obliquely upward a semicylindrical portion or one partial neck 56, while from the same side of sole shell 53, there also extends obliquely upward a semicylindrical portion or the other partial neck 57. Said semicylindrical portions 56 and 57 are combined together so as to form neck 59 for connecting shaft 58 thereto. In the edges of said face shell 52 are formed stepped portions 60 in order to anchor said face shell 52 to the edges of sole shell 53, upper shell 54 and side and back shell 55. Said shells 52,53,54 and 55 are manufactured by forging metal plates, wherein the thickness diminishes in the following sequence, the thickness "Ta" of sole shell 53, "Tb" of side and back shell 55, and "Tc" of upper shell 54. (i.e., $Ta>Tb>Tc$).

Reference numeral 61 designates shaft mounting pipe, of which the upper end 62 is approximately evenly provided relative to the upper end of said neck 59, while the lower end 63 is connected with said sole shell 53, as shown in FIG. 18. Said upper end 62 is formed with neck mounting flange 64 which is tapered so as to correspond to the inner surface of said neck 59. On the other hand, to the lower end 63 of said mounting pipe 61 is fixed metalic lower flange 65, which is welded to said sole shell 53 so that said mounting pipe 61 is inclined at a desirable lie angle. Said lower end 63 of said mounting pipe 61 is provided with injecting holes 73 for injecting filler 72 such as urethane, therein, as shown in FIG. 18.

With the composite structure thus made, face shell 52 is, first of all, integrally welded to sole shell 53 and side and back shell 55 through said stepped portions 60 such that said face shell 52 is inclined at a predetermined loft angle. Thereafter, the upper end 62 and the lower end 63 of mounting pipe 61 are attached to the inner surface 56 of neck 59 and the inner surface of sole shell 53 by means of jig or the like (not shown) respectively, when said flange 64 closely contacts said inner surface 56 of neck 59 to be integrally welded. After lower flange 65 is fixed to lower end 63 of mounting pipe 61, said lower flange 65 is aligned to sole shell 53 so that said mounting shaft 61 may be inclined at a predetermined lie angle. After that, upper shell 54 is connected to said face shell 52, side and back shell 55 respectively, in which case, stepped portion 60 of face shell 52 is engaged with upper shell 54.

After head body 51 is thus formed, filler 72 such as urethane foam or the like is injected into hollow portion 71. When filler 72 is injected from upper end 62 of mounting pipe 61, said filler 72 enters said injecting holes 73 through mounting pipe 61 so as to fill said hollow portion 71. At this injection process, the lower end 63 of mounting pipe 61 is padded with something (not shown) to prevent filler 72 from leaking therefrom. Thereafter, shaft 58 is inserted into mounting pipe 61 to be connected by means of welding or bonding or the like.

Since tapered flange 64 is provided to closely contact neck 59 of shaft 58, the connection-intensity of head body 51 with neck 59, mounting pipe 61 and shaft 58 is greatly improved. Moreover, as injecting holes 73 are provided for injecting filler 73 so as to communicate the inside of mounting pipe 61 with the outside threrof or hollow portion 71, injecting holes are not needed any longer in sole shell 53, which enables filler 72 to be easily filled. Still moreover, since the edges of face shell 52 are formed with stepped portions 60, precise alignment is attained in matching sole shell 53, upper shell 54, and side and back shell 55 with said face shell 52. Furthermore, as the lower part of mounting pipe 61 is provided with lower flange 65 in order to connect lower end 63 of mounting pipe 61 to the inner surface of sole shell 53, said lower end 63 is capable of being fixed to any inside position of sole shell 53, whereby each lie angle of mounting pipe 61 or shaft 58 is capable of being accurately provided.

Figure 20:
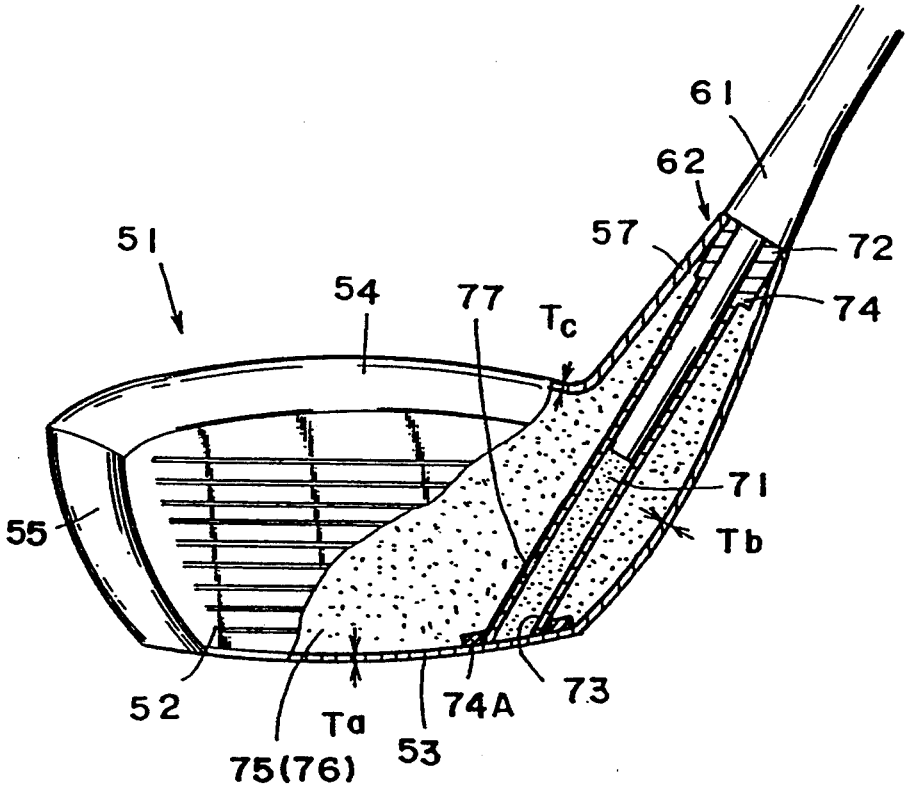
Figure 21:
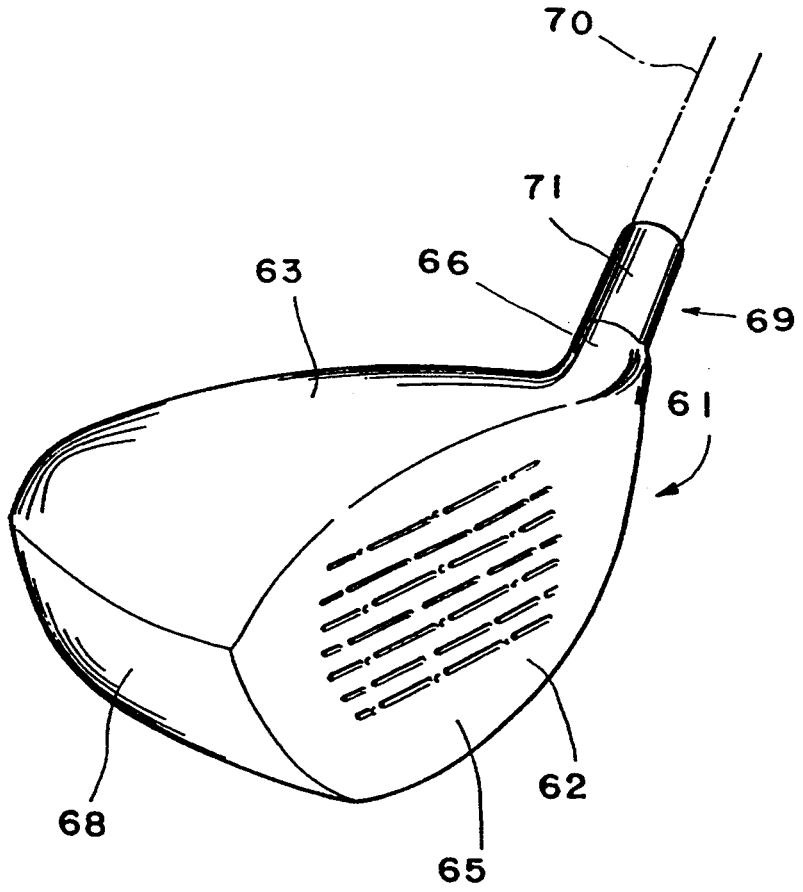
FIGS. 21 to 24 illustrate a method of manufacturing a golf clubhead of a composite structure according to the ninth embodiment of the present invention.

In FIGS. 19 to 20 showing the eighth embodiment of the invention, there is provided head body 51 which is made of aluminium alloy or stainless steel, iron or the like comprising head body shell 51 and face shell 52, said face shell 52 being provided at the front of said head body 51, inclining at a predetermined loft angle. Said head body shell 51 is composed of sole shell 53 provided at the lower surface thereof, upper shell 54 provided at the upper surface thereof, side peripheral shell 55 provided laterally and back shell 56 provided at the back thereof.

From the one side of upper shell 54, there extends obliquely upward semicylindrical portion or one partial neck 57, while from the same side of side peripheral shell 55, there also extends obliquely upward semicylindrical portion or the other partial neck 58. The edges 59 and 60 of said semicylindrical portions 57 and 58 are combined together so as to form neck 62 for connecting shaft 61 thereto. In the edges of said face shell 52 are formed stepped portions 63 in order to anchor said face shell 52 to the edges of sole shell 53, upper shell 54 and side peripheral shell 55. Said head body shell 51 is cut or drawn by press working of a metal plate, wherein the thickness diminishes in the following sequence, the thickness "Ta" of sole shell 53, "Tb" of side peripheral shell 55 and back shell 56, and "Tc" of upper shell 54. (i.e., Ta>Tb>Tc).

Reference numeral 71 designates shaft mounting pipe, of which the upper end 72 is approximately evenly provided relative to the upper end of said neck 62, while the lower end 73 is connected with said sole shell 53. Said upper end 72 is formed with neck mounting flange 74 which is tapered so as to correspond to the inner surface of said neck 62. On the other hand, to the lower end 73 of said mounting pipe 71 Is fixed to metallic lower flange 74A, which is positioned on said sole shell 53 to be welded thereto so that said mounting pipe 71 is inclined at a desirable lie angle.

Said lower end 73 of said mounting pipe 71 is provided with injecting holes 77 for injecting filler 76 such as urethane or the like therein, as shown in FIG. 20.

With the composite structure thus made, face shell 52 is, first of all, integrally welded to head body shell 51 through said stepped portions 63 such that said face shell 52 is inclined at a predetermined loft angle. Thereafter, the upper end 72 and the lower end 73 of mounting pipe 71 are connected to partial neck 57 and the inner surface of sole shell 53 by means of jig or the like (not shown) respectively, when said flange 74 closely contacts said inner surface 56 of neck 62 to be integrally welded. After lower flange 74A is fixed to lower end 73 of mounting pipe 71, said lower flange 74A is aligned to sole shell 53 and is back-welded from the outside thereof so that said mounting shaft 71 may be inclined at a predetermined lie angle. After that, said face shell 52 is welded to head body shell 51 through stepped portions 63 engaged with the edges of head body shell 51.

After head body 51 is thus formed, filler 76 such as urethane foam or the like is injected into hollow portion 75. When filler 76 is injected from upper end 72 of mounting pipe 71, said filler 76 enters injecting holes 77 through mounting pipe 71 so as to fill said hollow portion 75.

The eighth embodiment is advantageous in that sole shell 53, upper shell 54, side peripheral shell 55 and back shell 56, which are in delicate relationship with respect to the center of gravity and the balance, are capable of being precisely formed because of fewer welded portions thereof.

In FIGS. 21 to 24 showing the ninth embodiment of the invention, there is provided head body 61 comprising metal shells of face shell 62, upper shell 63, side peripheral and sole shell 4, of which the edges are welded to integrally form said head body 61.

Figure 22:
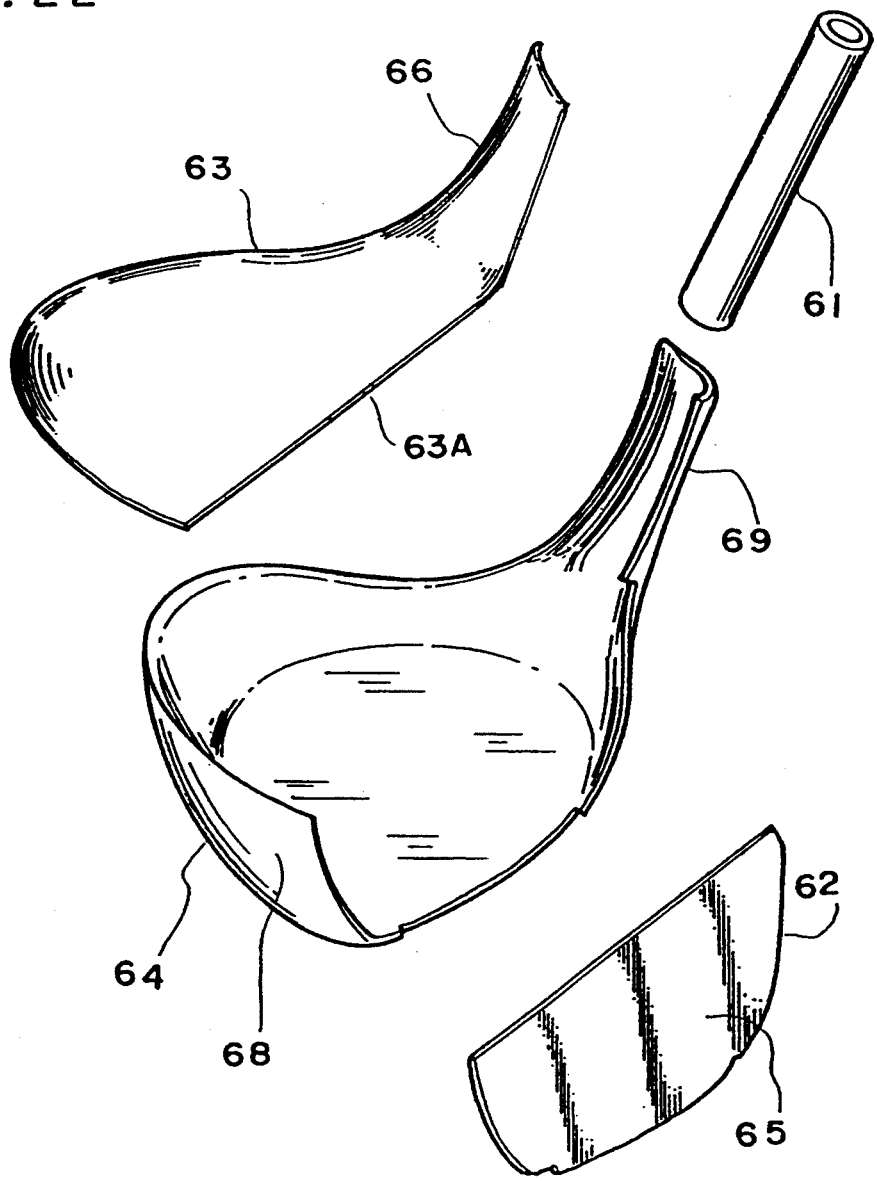
Figure 23:
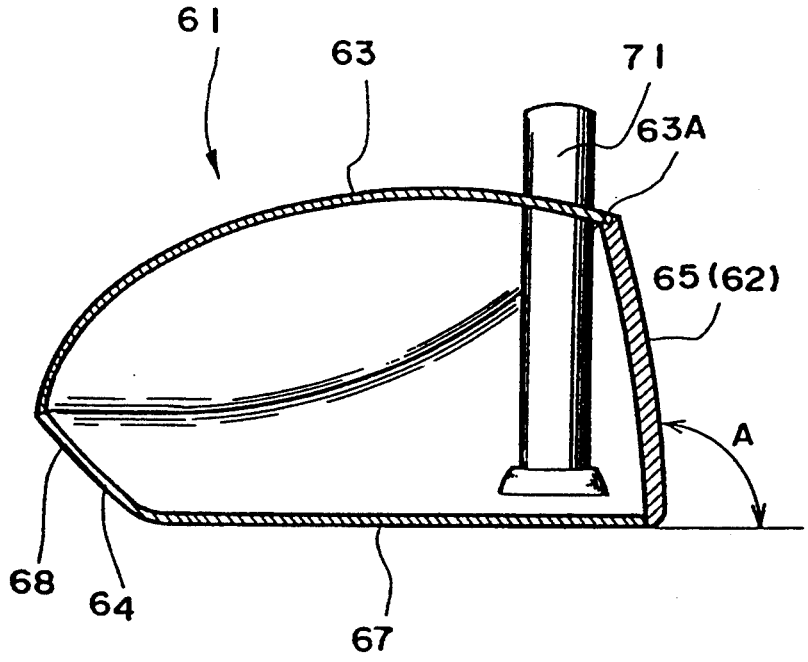

Said shells are formed by press working of metal plate such as titanium, titanium alloy, stainless steel, iron or the like. The front surface of said face shell 62 is formed with face 65 on which balls are to be hit, while one side of said upper shell 63 is provided with semicylindrical portion 66 extending obliquely upward. Said side peripheral and sole shell 64 having sole 67 in the lower position is formed with side peripheral surface 68 so that it may cover both the lateral sides and the back of head body 61. As shown in FIG. 22, from one side of said side surface 68, there extends obliquely upward semicylindrical portion 69. Sandwiched by said semicylindrical portions 66 and 69 is shaft mounting pipe 71, of which the upper end is secured to said semicylindrical portions 66 and 69, while the lower end thereof is secured to sole 67. To thus formed pipe 71 is fixed the lower end of shaft 70.

Figure 24:
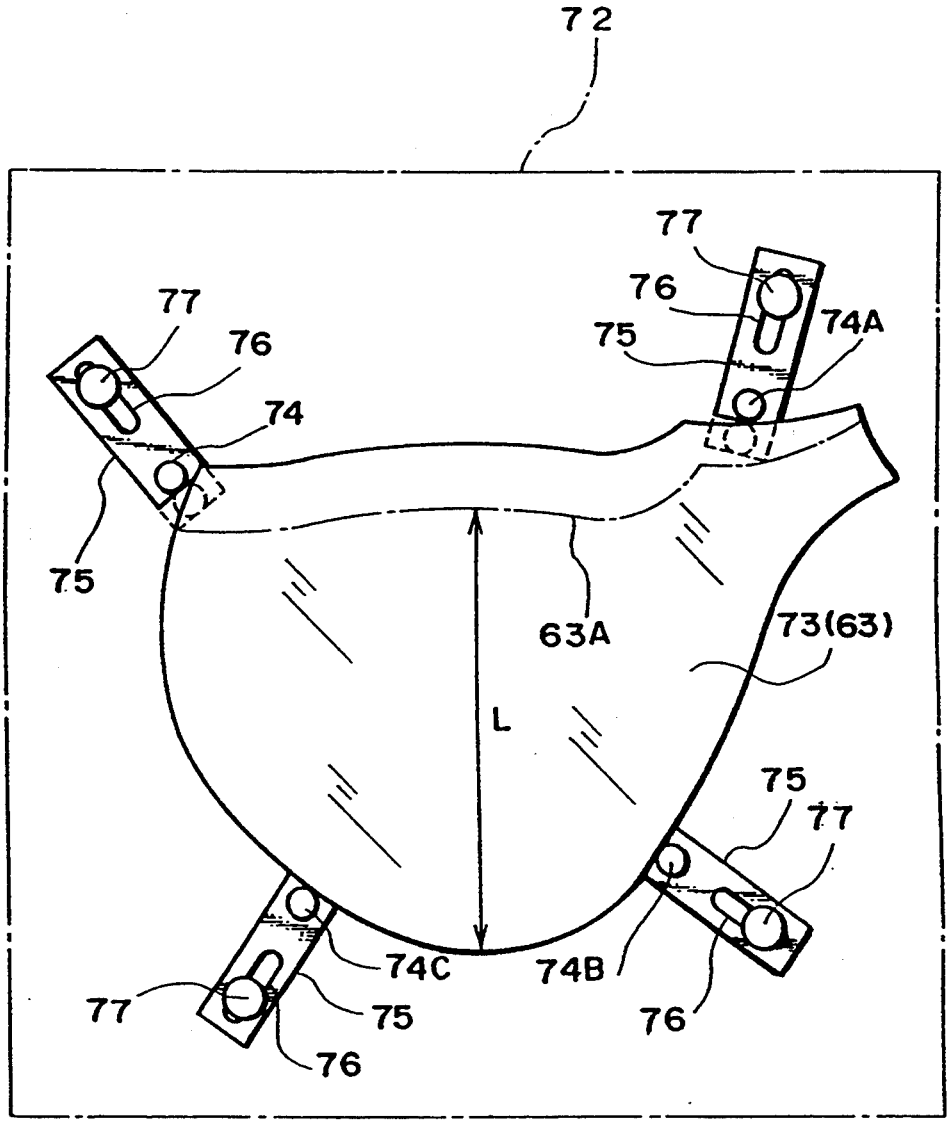
Figure 25:
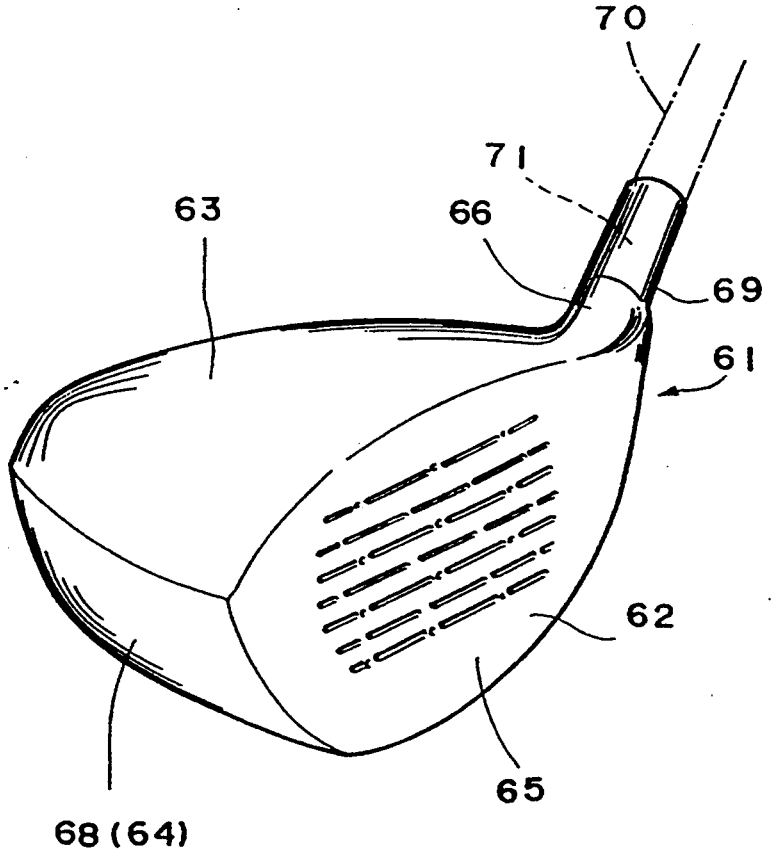
FIGS. 25 to 28 illustrate a method of manufacturing a golf clubhead of a composite structure according to the tenth embodiment of the present invention.
Figure 26:
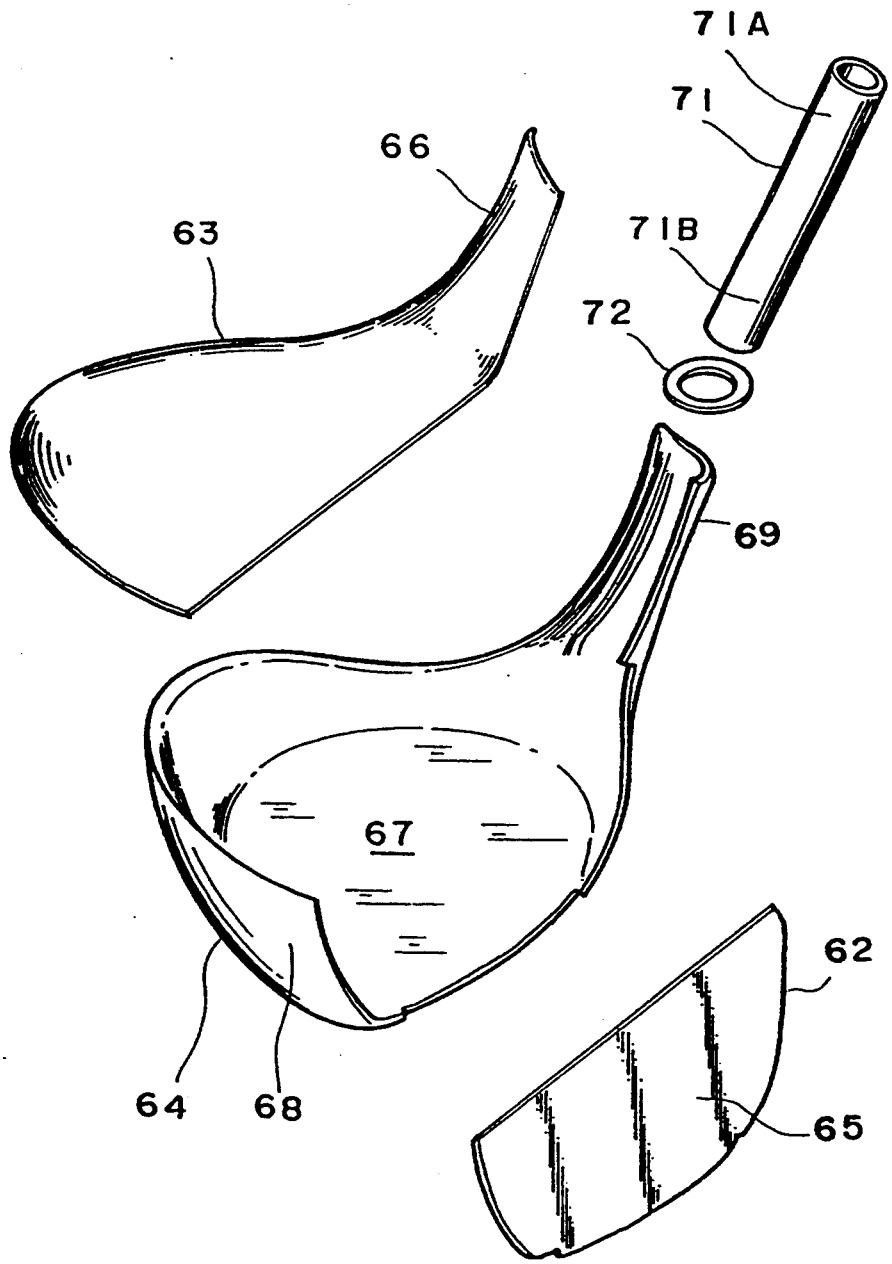
Figure 27:
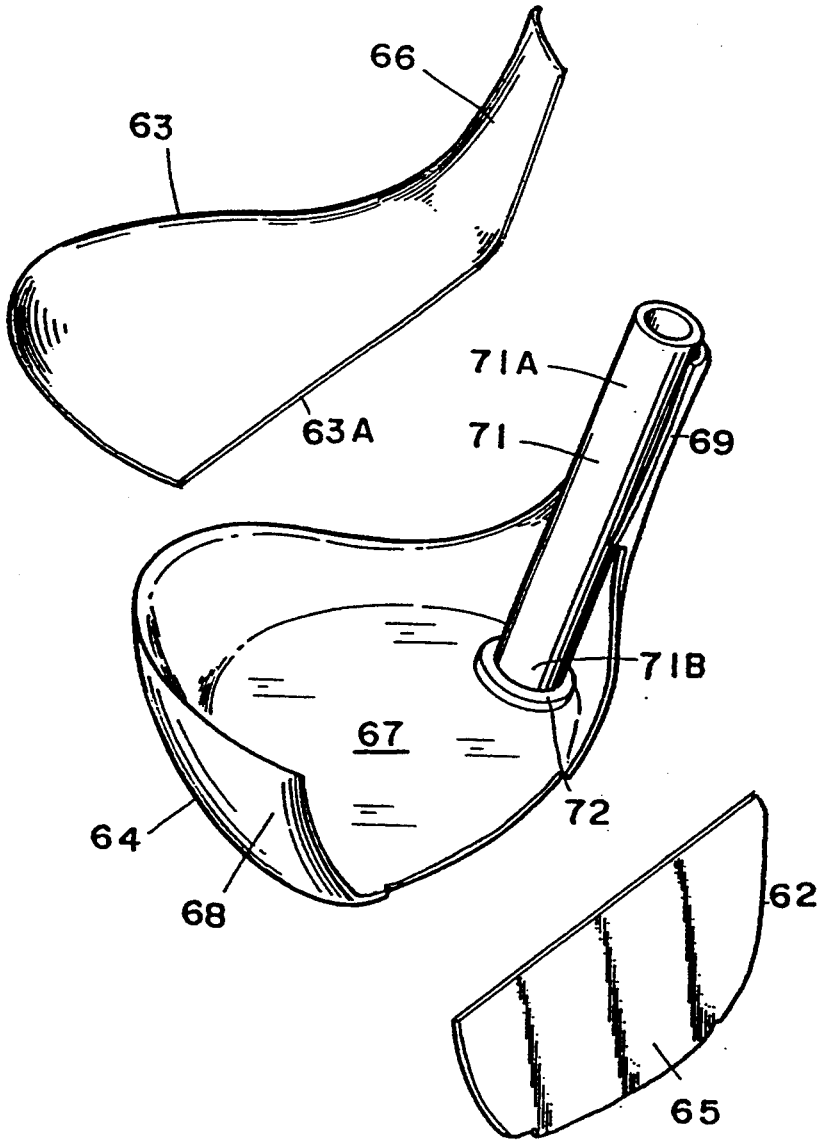
Figure 28:
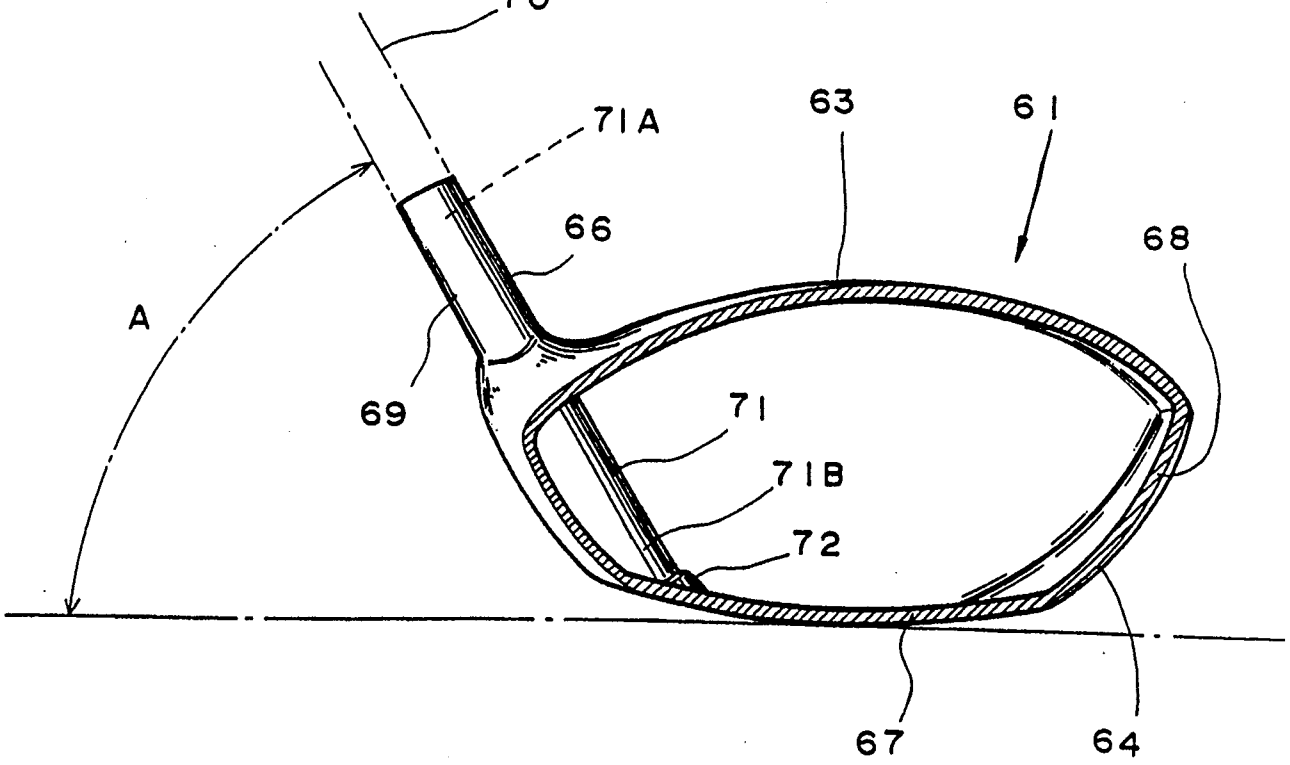

In FIG. 24 showing a die for press working of said upper shell 63, there are illustrated stoppers 74,74A,74B and 74C on four sides of lower die 72 to lock the both sides of fore and aft parts of tabular metal plate 73 of a predetermined configuration. These stoppers 74,74A,74B and 74C are fixed to the ends of slide plates 15, which are formed with elongated holes 76 into which screws 77 are inserted. Said screws 77 can be screwed into female screws (not shown) formed in said lower die 72 to be secured thereto.

Hereinafter are explained the manufacturing process and the action of the present invention.

After said face shell 62, upper shell 63, side peripheral and sole shell 64 are manufactured by means of die-press working respectively, mounting pipe 71 is welded to side peripheral and sole shell 64. And then, upper shell 63 is welded to said side peripheral sole shell 64, while semicylindrical portion 66 is welded to mounting pipe 71. After that, face 65 is welded at a predetermined loft angle to form head body 61. In the case of enlarging the loft angle, screws 77 are loosened in advance so that slide plates 75 are moved together with stoppers 74,74A,74B and 74C toward the center of lower die 72, as shown in a chain line of FIG. 24, and then said screws 77 are tightened again. Thereafter. an upper die (not shown) is applied to press working of metal plate 73, whereby the length L of upper shell member 63 is provided slightly shorter than the set length thereof.

Accordingly, in manufacturing a golf clubhead of the ninth embodiment, upper shell member 63 with the comparatively short longitudinal length L is welded to side peripheral and sole shell member 64, while face shell member 62 is welded to front edge 63 A, whereby said front edge 63A is positioned comparatively backward, which enables a loft angle to be enlarged.

The ninth embodiment makes it easier to adjust a loft angle to integrally form a golf club head without using a conventional jig for adjusting a loft angle in welding a face shell member.

Further, in case of face 65 or metal plate 73 being thin, a head body 61 is capable of being easily integrally formed so that the "sweet area" can be adjusted with ease.

FIGS. 25 to 28 show the tenth embodiment of the present invention, wherein reference numeral 72 denotes auxiliary mounting member such as a washer or the like which is used in securing lower end 71B of said mounting pipe 72 to sole 67.

First of all, in order that shaft 70 may be inclined at a predetermined lie angle A, the lower end 71B of mounting pipe 71 is welded to sole 67 through auxiliary mounting member or a washer 72, while the upper end 71A thereof is tack-welded to the upper end of a first semicylindrical member 66. Secondly, to the frond edge of side peripheral and sole shell member 64 is welded face shell member 62 so that the face shell member face 65 may be inclined at a predetermined elevation angle. Thereafter, upper shell member 63 is welded to the upper edges of said side peripheral and sole shell member 64 and face shell member 62, respectively. Then, to a second semicylindrical member 69 is welded mounting pipe 71 in welding a first semicylindrical member 66 thereto.

The tenth embodiment is advantageous in that a lie angle A can be easily adjusted and said lower end 71B of mounting pipe 71 can be firmly secured to sole 67 by means of axiliary mounting member 72. Accordingly, in the forgoing embodiments in which the upper shell member is formed thinner, while the side peripheral and sole shell member is formed thicker, the lie angle A can be adjusted with ease.

The present invention should not be limited to the embodiments thus far described but can be modified within the scope thereof.

For example, a head body may be integrally formed by combining a plurality of shells horizontally devided into the upper and the lower parts, which are provided by press woking of metal plate.

What is claimed is:

1. A golf clubhead with a head body of a composite structure, comprising;

a plurality of separate crusts;

a hollow portion formed therein and a sole being provided by one of said plurality of separate crusts;

said head body having a top;

said separate crusts being manufactured by press working of metal plates, respectively for each crust, of titanium, titanium alloy or aluminum alloy respectively, the thickness of said separate crusts being such that the thickness of a crust used for the sole of the clubhead is greater than the thickness of a crust used for a side-peripheral surface part used for the clubhead, and the thickness of a crust used for said side-peripheral surface part of the clubhead is greater than that of a crust used for the top of the clubhead, and said hollow portion having been formed by combining said plurality of separate crusts into a head body.

2. A golf clubhead with a head body of a composite structure according to claim 1, wherein the sole of said head body has an elongated window-shaped aperture smaller than the sole of said head body;

a display plate fitted within said aperture, the specific gravity of said display plate being greater than that of said sole.

3. A golf clubhead with a head body of a composite structure according to claim 1, wherein said head body is provided therein with frames made up of a dozen linear members such that the linear members are assembled corresponding in shape to said hollow portion to form approximately square-shaped front and rear frames, and approximately trapezoidal-shaped upper, lower and side frames respectively, with said front frame having a face member secured thereto, and said bottom lower frame having said sole member secured thereto.

4. A golf clubhead with a head body of a composite structure according to claim 2, wherein said side-peripheral and said sole member are formed of titanium or titanium alloy, said display plate is formed of beryllium copper alloy of which the specific gravity is greater than that of said sole.

5. A golf clubhead having a head body formed by combining a plurality of crusts with a shaft connected to a neck through a hosel, the inside of said neck having a shaft mounting pipe, said mounting pipe having an upper part formed with a neck mounting flange abutting the inside of said neck, and said neck mounting flange being thicker cross-section than said shaft mounting pipe.

6. A golf clubhead having a head body according to claim 5, wherein said shaft mounting pipe has a lower part provided with a lower flange, of which the thickness is greater than that of said shaft mounting pipe, the lower part of said shaft mounting pipe being connected to the sole crust of said head body through said lower flange.

* * * * *